US005797310A

United States Patent [19]

Casey et al.

[11] Patent Number: 5,797,310

[45] Date of Patent: Aug. 25, 1998

[54] DUAL SELF LEVEL VALVE

[75] Inventors: Todd Casey, Victoria, Minn.; Alan Jackson, Halstead, Kans.

[73] Assignee: Eaton Corporation, Cleveland, Ohio

[21] Appl. No.: 792,726

[22] Filed: Jan. 29, 1997

[51] Int. Cl.[6] ..... F15B 11/00; F15B 13/00

[52] U.S. Cl. ..... 91/515; 91/520; 91/532; 60/424

[58] Field of Search ..... 91/511, 514, 515, 91/520, 532; 60/420, 424

[56] References Cited

U.S. PATENT DOCUMENTS

| | | | |
|---|---|---|---|
| 4,034,649 | 7/1977 | Harvey et al. | 91/515 |
| 4,337,959 | 7/1982 | Bettin et al. | 91/515 X |
| 4,510,849 | 4/1985 | Khramtsov et al. | 91/515 |
| 4,709,618 | 12/1987 | Zongker | 91/31 |
| 4,923,362 | 5/1990 | Fryk | 414/700 |

*Primary Examiner*—Hoang Nguyen
*Attorney, Agent, or Firm*—L. J. Kasper

[57] ABSTRACT

A self-leveling system controlling a boom (13) and a bucket (15) by double acting cylinders (17, 19). The system includes a self leveling valve assembly (27) including a first valve section (27*a*) including a flow divider spool (41) whereby flow from the rod end of the boom cylinder (17) is divided, one portion flowing to the head end of the bucket cylinder (19). The valve assembly also includes a second valve section (27*b*) including a flow dividing spool (61), whereby flow from the head end of the boom cylinder (17) is divided, a portion flowing to the rod end of the bucket cylinder, as the boom (13) is lowered. The self leveling valve assembly (27) includes capability whereby, even when the bucket cylinder (19) is fully extended or fully retracted, it is still possible to operate the boom cylinder (17).

5 Claims, 3 Drawing Sheets

DUAL SELF LEVEL VALVE

BACKGROUND OF THE DISCLOSURE

The present invention relates to controls for hydraulic power systems, and more particularly, to control valves that achieve automatic leveling of a bucket on the front end of a loader or similar vehicle, during movement of the boom arm to which the bucket is attached.

Typically, on a vehicle of the type to which the invention relates, there is a hydraulic cylinder to control the raising and lowering of a boom arm, and a separate hydraulic cylinder for manipulating the bucket on the front end of the boom arm. The boom cylinder is controlled by one directional control valve, while the bucket cylinder is controlled by a separate directional control valve. In the hydraulic systems of the type to which the invention relates, the boom cylinder and the bucket cylinder are disposed in a "series" type circuit, i.e., one in which fluid flows to the boom cylinder, and then a portion of the fluid exiting the boom cylinder flows downstream to the bucket cylinder. However, the directional control valves are not necessarily disposed in a series type circuit.

In addition to the boom and bucket cylinders and the two directional control valves, the hydraulic power system of the invention includes a self leveling valve. As is well known to those skilled in the art, in the absence of any self leveling function, it is necessary for the operator of the vehicle to operate both valves, one with each hand, in an effort to maintain the bucket in a level position during movement of the boom. Those skilled in the art will understand that, as used herein, the term "level" may mean either literally level in the sense of parallel with the ground, or may simply mean that the bucket is maintained in a constant position during boom movement.

A series self leveling valve of the type which is in commercial use is known from U.S. Pat. No. 4,709,618, assigned to the Assignee of the present invention and incorporated herein by reference. The self leveling valve of the cited patent has enjoyed substantial commercial success, and functions satisfactorily in maintaining the bucket level as the boom is raised. However, the self leveling valve of the cited patent does not include any capability for maintaining the bucket level while the boom is being lowered.

U.S. Pat. No. 4,923,362, incorporated herein by reference, illustrates a boom and bucket system for a loader and suggests that the desired orientation of the bucket may be maintained, as the boom is either raised or lowered, but the disclosed system requires position feedback sensors on both the boom and the bucket. The fluid used to accomplish the bucket leveling is taken from both the boom cylinder return flow, and from the system pump. In the system of the cited patent, the need for position feedback sensors add substantially to the overall cost and complication of the system, and also increases the opportunity for failures to occur within the system.

SUMMARY OF THE INVENTION

Accordingly, it is an object of the present invention to provide an improved self leveling hydraulic system of the type which is capable of maintaining the bucket in a level position while the boom is being either raised or lowered.

It is a related object of the present invention to provide such an improved self leveling hydraulic system which is of the "open loop" type, i.e., does not require position feedback sensors and control logic, in order to maintain the bucket in a level position.

It is a further object of the present invention to provide an improved self leveling hydraulic system which accomplishes the above-stated objects, and in which it is still possible to either raise or lower the boom even when the bucket is already fully extended or retracted.

The above and other objects of the present invention are accomplished by the provision of an improved self leveling hydraulic system controlling at least two functions including a boom and a bucket. The system includes double acting cylinders for the boom and bucket, the cylinders being controlled by separate boom and bucket directional control valves, the system comprising a circuit with the boom cylinder disposed upstream of the bucket cylinder, and further including a source of pressure supplying the control valves. A first self leveling valve section includes a flow dividing valve in fluid communication with the rod end of the boom cylinder, whereby the flow from the rod end of the boom cylinder is divided into first and second flows. A first passage means communicates the first of the flows to the head end of the bucket cylinder to supply a sufficient flow to maintain the bucket at a level position as the boom is raised, and a second passage means communicates the second of the flows back to the control valves.

The improved self leveling hydraulic system is characterized by a second self leveling valve section including a flow dividing valve in fluid communication with the head end of the boom cylinder, whereby the flow from the head end of the boom cylinder is divided into first and second flows. A third passage means communicates the first of the flows to the rod end of the bucket cylinder to supply a sufficient flow to maintain the bucket at a level position as the boom is lowered. A fourth passage means communicates the second of the flows back to the control valves.

DETAILED DESCRIPTION OF THE PREFERRED EMBODIMENT

Figure 1:
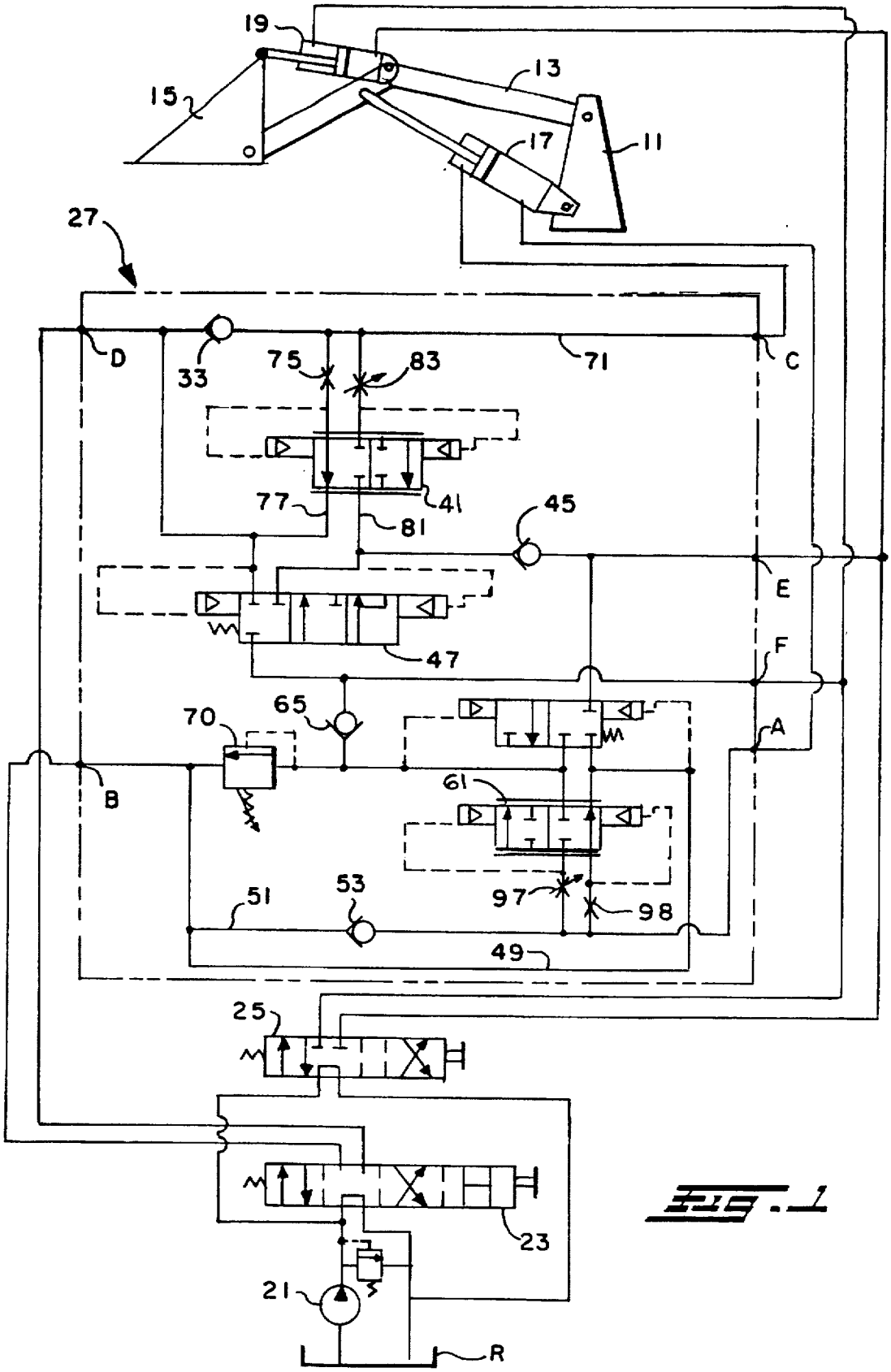
FIG. 1 is a hydraulic schematic of a self leveling hydraulic system made in accordance with the present invention.

Referring now to the drawings, which are not intended to limit the invention, FIG. 1 illustrates the overall hydraulic system including a vehicle frame 11 to which is pivotally mounted a boom arm 13. At the forward end of the boom arm 13 is attached a bucket 15, with movement of the boom 13 being controlled by a boom cylinder 17, and movement of the bucket 15 being controlled by a bucket cylinder 19.

The overall vehicle hydraulic system receives pressurized fluid from a pump 21, the output of which is communicated to a directional control valve 23, which controls the boom cylinder 17, and to a directional control valve 25, which controls the bucket cylinder 19. Although the directional control valves 23 and 25 are essential elements of the overall system, the particular form they take is not an essential feature of the present invention, and any one of a number of well known types of directional control valves may be utilized.

Figure 2:
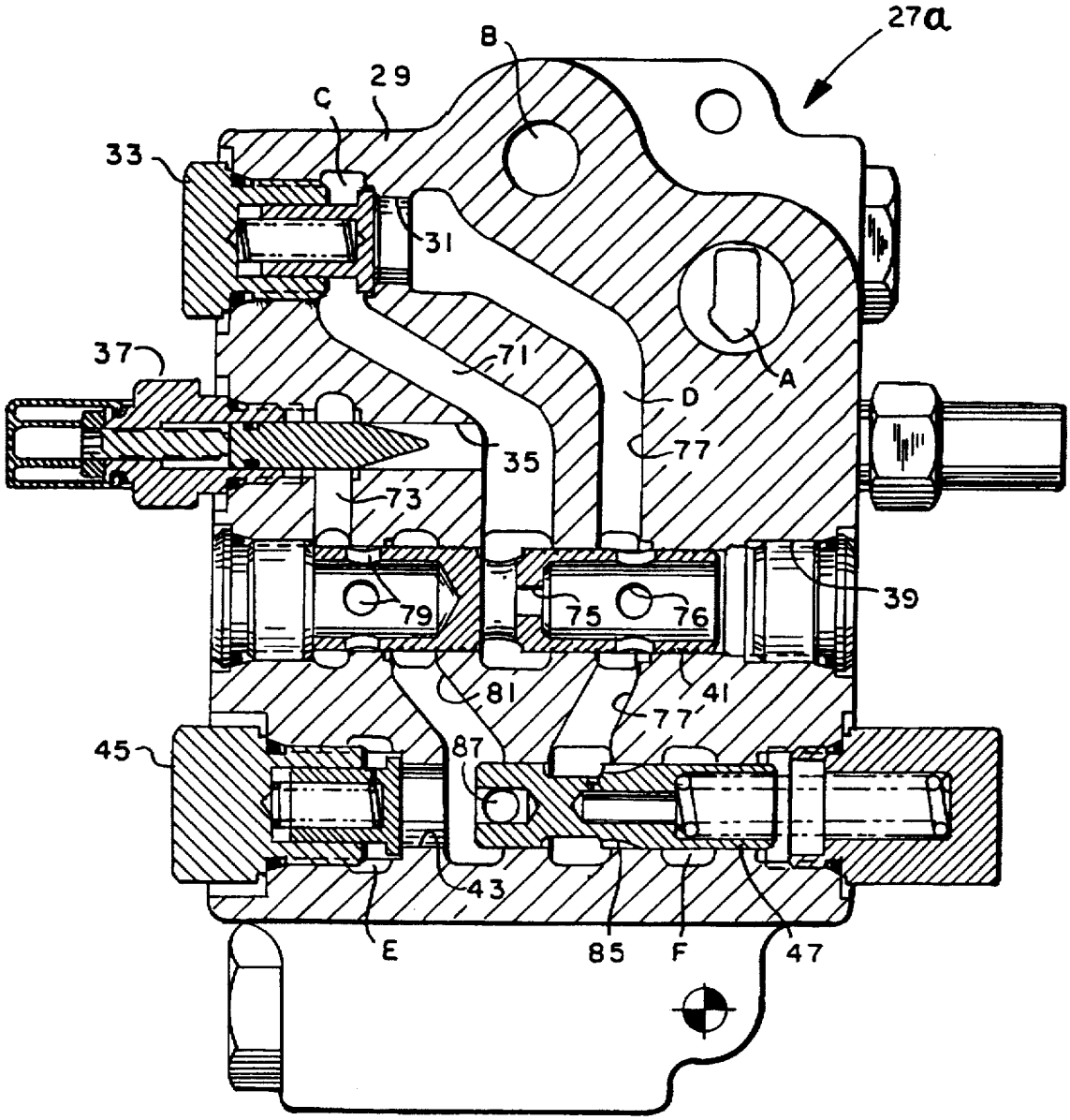
FIG. 2 is a longitudinal sectional view showing an "upper" section of the self leveling valve shown schematically in FIG. 1.
Figure 3:
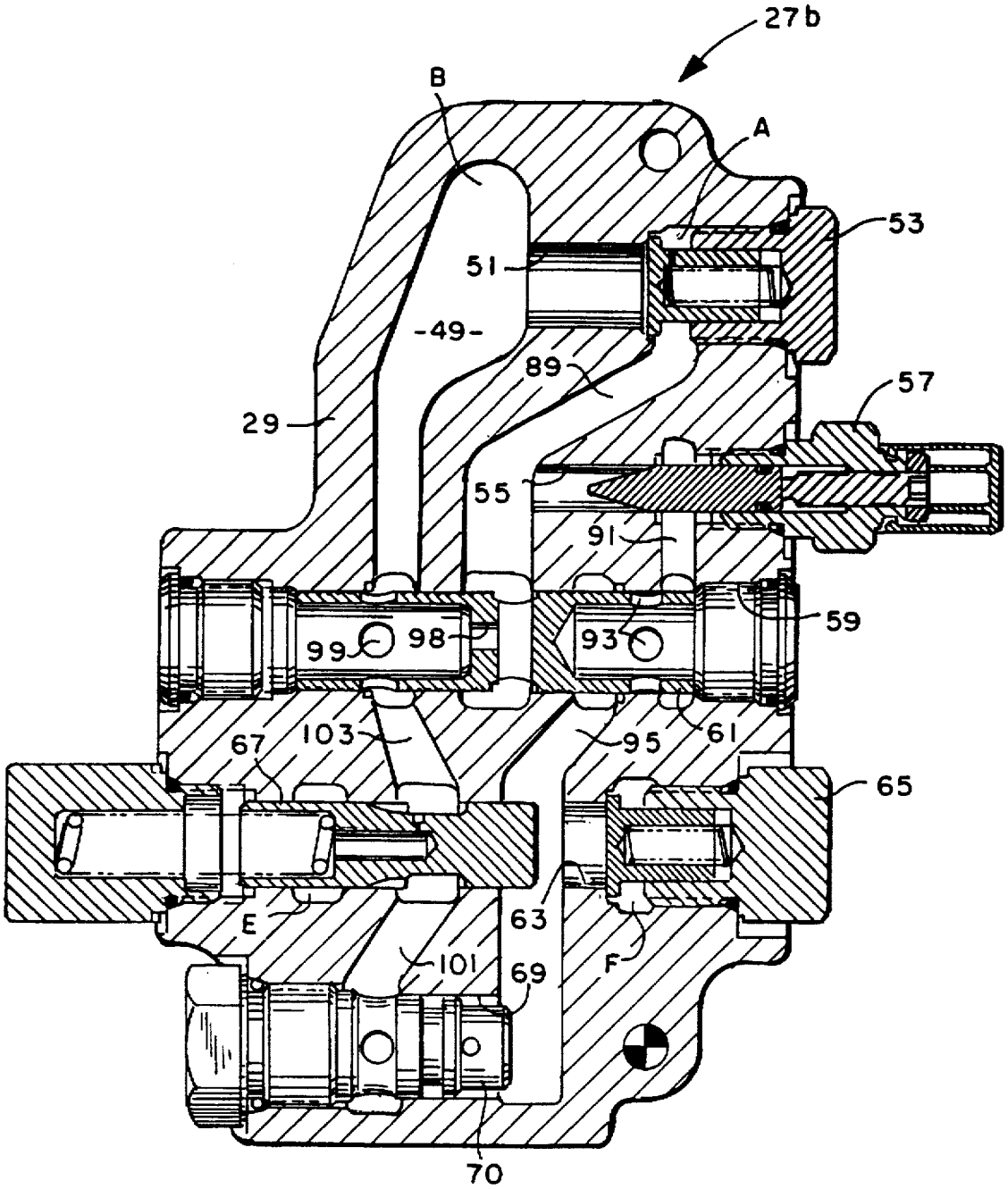
FIG. 3 is a longitudinal sectional view of a "lower" section of the self leveling valve shown schematically in FIG. 1.

Positioned between the control valves 23 and 25 and the boom and bucket cylinders 17 and 19, respectively, is a self leveling valve assembly, generally designated 27, including a common valve housing 29 in which is disposed a first (or "upper") self-leveling valve section 27*a* (see FIG. 2) and a second (or "lower") self-leveling valve section 27*b* (see FIG. 3).

Referring now to FIG. 1, in conjunction with FIGS. 2 and 3, the valve housing 29 defines a plurality of ports, none of which is actually illustrated as a typical port in FIGS. 2 and 3. However, each of the ports is designated in the drawing figures by a capital letter, to distinguish the ports from various other structural elements. Each of the ports is shown schematically in FIG. 1, and in FIGS. 2 and 3 that portion of the valve assembly most nearly associated with the actual port will bear the designation of the port. The valve housing 29 defines a port A which is connected to the head end of the boom cylinder 17; a port B, connected to the boom raise side of the control valve 23; a port C, connected to the rod end of the boom cylinder 17; a port D, connected to the lower side of the control valve 23; a port E, connected to the head end of the bucket cylinder 19 and to one port of the bucket control valve 23; and a port F, connected to the rod end of the bucket cylinder 19 and to the other port of the bucket control valve 23.

In order to understand the relationship of the upper section 27*a*, shown in FIG. 2, and the lower section 27*b*, shown in FIG. 3, it should be noted that the upper section is preferably disposed on top of the lower section, and that the cored portions of the valve housing 29 which are labeled, in FIGS. 2 and 3, as ports A, B, E and F are in direct, open communication with each other, and immediately above and below each other.

In the upper section 27*a* (see FIG. 2) of the self leveling valve assembly 27, the valve housing 29 defines a plurality of transverse bores, each of which includes one or more valve elements (some of which are also identified in the schematic of FIG. 1). In a bore 31 there is disposed a load check valve 33, and in a bore 35 there is disposed an adjustable orifice member 37. In a bore 39 there is disposed a flow divider valve spool 41. Finally, in a bore 43 there is disposed a load check valve 45 and an unloading spool 47.

In the lower section 27*b* (FIG. 3) of the valve assembly 27, the valve housing 29 defines a large cored area 49 as well as a plurality of transverse bores, each of which includes one or more valve elements (some of which are also identified in the schematic of FIG. 1). In a bore 51, which is in open communication with the cored area 49, there is disposed a load check valve 53. In a bore 55 there is disposed an adjustable orifice member 57. In a bore 59, there is a flow divider valve spool 61. In a bore 63 there is disposed a load check valve 65 and an unloading spool 67. Finally, in a bore 69, there is disposed a relief valve assembly 70.

Self-Leveling Boom Raise

In operation, when it is desired by the vehicle operator to raise the boom 13, while the bucket 15 remains "level" (i.e., in a fixed orientation relative to the ground), the operator moves the directional control valve 23 to the right in FIG. 1, but does not need to move the directional control valve 25 from its "neutral" (or centered) position shown in FIG. 1. With the valve 23 actuated, fluid flows from the pump 21, through the valve 23 to the port B. Pressurized fluid entering port B flows through the bore 51 in the lower section 27*b*, then past the load check valve 53 and out port A, then flows to the head end of the boom cylinder 17.

As the boom cylinder 17 extends, all of the flow from the rod end of the boom cylinder 17 is communicated back to the port C of the upper section 27*a*. Return flow entering the port C then flows through a passage 71, and a portion of the fluid in the passage 71 flows past the adjustable orifice member 37 (not shown in FIG. 1), then through a passage 73 to the left end (in FIG. 2) of the flow divider valve spool 41. At the same time, the rest of the fluid in the passage 71 is flowing toward the middle of the divider spool 41, then flows through a fixed orifice 75, after which the fluid flows radially outward through openings 76 in the divider spool 41, and then into a passage 77, from where it is communicated out through the port D and back through the control valve 23 to a system reservoir R. The portion of the fluid in the passage 71 which flowed past the orifice member 37 and through the passage 73 is effective to bias the divider spool 41 to the right in FIG. 2. As this occurs, a set of openings 79 defined by the spool 41 cooperate with a core and passage 81 to form a variable orifice (identified as "83" in FIG. 1). The fluid flowing through the passage 81 then flows past the load check valve 45, to the port E, and from there to the head end of the bucket cylinder 19.

As will be understood by those skilled in the art, the adjustable orifice member 37 must be properly adjusted to achieve the appropriate flow split (i.e., of fluid flowing through the passage 71) so that the amount of fluid flowing to the head end of the bucket cylinder 19, relative to the amount of fluid flowing out of the rod end of the boom cylinder 17, will be just the amount of fluid needed to maintain the bucket 15 in a level position.

The pressure in the passage 81, in addition to unseating the load check valve 45, will bias the unloading spool 47 to the right in FIG. 2 to a position such that fluid returning from the rod end of the bucket cylinder 19 to the port F can flow through a set of notches 85 on the spool 47, then flow into the lower end of the passage 77, combining with the flow which will exit through the port D and return to the reservoir R.

Raise With Bucket Cylinder Fully Extended

One of the problems associated with the prior art devices has been that, once the bucket is either fully extended or fully retracted in the self leveling mode, further movement of the boom is prevented. In view of the series arrangement between the boom cylinder 17 and the bucket cylinder 19, once the bucket cylinder 19 would have, in the prior art, reached the limit of its travel in either direction, the boom cylinder 17 would have been "stalled", i.e., it could not move, because there is a downstream blockage of flow (i.e., the fully extended bucket cylinder 19).

In accordance with the present invention, once the bucket cylinder 19 is fully extended, there is no longer any need for a flow path returning from the rod end, and through the port F and through the unloading spool 47 as was described previously. Instead, with the bucket cylinder 19 fully extended, there is trapped fluid between the load check valve 45 and the head end of the bucket cylinder 19. In this condition, fluid in the passage 81 acts on the left end of the unloading spool 47 and biases it even further to the right in FIG. 2 (to the left in FIG. 1) to a position in which one or more openings 87 are open to the passage 77, thus relieving pressure in the passage 81 (through the passage 77 to the port D and the reservoir R) so that the boom cylinder 17 may continue to raise the boom 13 even though the bucket cylinder 19 is fully extended.

Self-Leveling Boom Lowering

When it is desired to lower the boom 13, while maintaining the bucket 15 level, the vehicle operator moves the directional control valve 23 to the left in FIG. 1 such that pressurized fluid is communicated from the pump 21 through the valve 23 to the port D. From there pressurized fluid flows past the load check valve 33 and out the port C to the rod end of the boom cylinder 17. As the boom cylinder 17 is retracted, flow from the head end is communicated to the port A, then flows through a passage 89 in the lower section (FIG. 3). The fluid in the passage 89 then splits, with a portion flowing through the bore 55 and past the adjustable orifice member 57, the setting of which determines the flow split through the flow divider spool 61. The portion of the fluid flowing past the orifice member 57 then flows through a passage 91 to the right end of the divider spool 61, biasing the spool 61 to the left in FIG. 3. With the divider spool 61 moved to the left, a series of openings 93 in the spool 61 cooperate with a core and passage 95 to define a variable orifice (identified as "97" in FIG. 1). The fluid flowing through the passage 95 then unseats the load check valve 65 and flows out port F to the rod end of the bucket cylinder 19, retracting the bucket cylinder 19 at a rate which will keep the bucket 15 level, as was described in connection with the "raise" mode of operation. The remainder of the fluid in the passage 89 flows through a fixed orifice 98, then out through openings 99 in the divider spool 61, through the cored area 49. The low pressure exhaust fluid in the cored area 49 then flows through the port B and returns through the control valve 23 to the reservoir R.

Boom Lowering With Bucket Cylinder Fully Retracted

When the boom cylinder 19 becomes fully retracted, the same problem is presented as was described previously, i.e., the need to continue moving the boom cylinder, even when the bucket cylinder 19 is unable to move because it has reached the end of its travel. Once the bucket cylinder 19 is fully retracted, fluid between the port F and the rod end of the bucket cylinder is trapped, and pressurized fluid in the passage 95 cannot unseat the load check valve 65. It is to accommodate this situation that the relief valve assembly 70 is included. As the pressure in the passage 95 rises, the relief valve 70 is unseated and the fluid pressure in the passage 95 is relieved to a passage 101 which is in open fluid communication, by means of a passage 103, with the cored area 49. Therefore, the fluid being relieved by the relief valve 70 is communicated to the cored area 49 and from there through the port B and back through the control valve 23 to the system reservoir R.

Those skilled in the art will understand that, when lowering the boom 13, it is important to be able to maintain the bucket 15 in a level position, regardless of whether it is loaded or empty. It would be desirable to have the boom cylinder rod-to-head ratio as close as possible to 1:1, in which case the setting of the pressure relief valve 70 could be nearly system pressure. However, such is not typical and, assuming by way of example only that the rod-to-head ratio is about 0.75, and if system pressure is about 2000 psi, it would be desirable to set the relief valve 70 to open at about 1500 psi, or less, neglecting the weight of the boom. By utilizing this relationship, the ability to continue moving the boom, even with the bucket cylinder fully retracted, will be assured. However, the setting of the relief valve 70 should be set at a pressure above that which is required to "curl" the bucket 19 (i.e., retract the bucket cylinder under load).

As is also well known to those skilled in the art, if it is desired to operate only the bucket cylinder 19, to either curl the bucket 15 or dump the bucket, that may be done simply by moving the directional control valve 25 to the right, or to the left (in FIG. 1), respectively, thus controlling the flow of fluid from the pump 21 through the valve 25 to either the rod end or the head end, respectively, of the bucket cylinder 19. This mode of operation is well known, forms no part of the present invention, and will not be described further.

Those skilled in the art will understand that the subject embodiment of the invention includes the adjustable orifice members 37 and 57, so that a single valve assembly 27 may be utilized on different vehicles, having different size boom and bucket cylinders, and various rod end to head end ratios. If a large number of the valve assemblies is to be used on a particular vehicle, with no changes in the boom and bucket cylinders, the variable orifice members 37 and 57 may be replaced by some sort of fixed orifice member, selected to suit the particular application.

As another alternative to the subject embodiment, the load check valves 33 and 53 could be replaced by solenoid valves, which, by way of example only, could be normally biased to the same closed position as the check valves 33 and 53. If the vehicle operator wished to deactivate the self level feature during the raise mode, he would actuate the solenoid valve in the place of the load check valve 33. Then, instead of fluid returning from the rod end of the boom cylinder 17 being split, to accomplish the self leveling, the valve would be open and the fluid returning through the port C would merely flow to the port D and back to the system reservoir without any of the fluid flowing to the bucket cylinder 19.

Similarly, if the operator wished to deactivate the self level feature while lowering the boom, he would actuate the solenoid valve in the place of the load check valve 53. Then, when fluid would return from the head end of the boom cylinder 17 and flow to the port A, the valve would be open, and rather than being split, all of the fluid would flow through the bore 51, to the cored area 49 and out the port B to the reservoir R.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

We claim:

1. A self-leveling hydraulic system controlling at least two functions including a boom and a bucket; double acting cylinders for said boom and bucket, said cylinders controlled by separate boom and bucket directional control valves, and a circuit with the boom cylinder disposed upstream of the bucket cylinder, and a source of pressure supplying said control valves; a first self-leveling valve section including a flow dividing valve in fluid communication with the rod end of said boom cylinder, whereby the flow from the rod end of the boom cylinder is divided into first and second flows; a first passage means communicating the first of the flows to the head end of said bucket cylinder to supply a sufficient flow to maintain said bucket at a level position as said boom is raised, and a second passage means communicating the second of the flows back to said control valves; characterized by:

(a) a second self-leveling valve section including a flow dividing valve in fluid communication with the head end of said boom cylinder, whereby the flow from the head end of the boom cylinder is divided into first and second flows;

(b) a third passage means communicating the first of the flows to the rod end of said bucket cylinder to supply a sufficient flow to maintain said bucket at a level position as said boom is lowered; and (c) a fourth passage means communicating the second of the flows back to said control valves.

2. A self-leveling hydraulic system as claimed in claim 1 characterized by said first self-leveling valve section including a pilot operated valve means having both an unloading function and a relief function, and being disposed in a fifth passage means and normally biased toward a closed position blocking flow from the rod end of said bucket cylinder to said second passage means, as said boom is raised.

3. A self-leveling hydraulic system as claimed in claim 1 characterized by said second self-leveling valve section including a pilot operated valve means having an unloading function, and being disposed in a sixth passage means, and normally biased toward a closed position blocking flow from the head end of said bucket cylinder to said control valves, as said boom is lowered.

4. A self-leveling hydraulic system as claimed in claim 3 characterized by said second self-leveling valve section including relief valve means operable to provide fluid communication from said third passage means to said sixth passage means, when said bucket is fully retracted.

5. A self-leveling hydraulic system as claimed in claim 1 characterized by said first self-leveling valve section is disposed in face-to-face engagement with, and in partially open fluid communication with, said second self-leveling valve section.

* * * * *